US006322061B1

(12) United States Patent
Maser et al.

(10) Patent No.: US 6,322,061 B1
(45) Date of Patent: Nov. 27, 2001

(54) UNIVERSAL AXLE AND DIFFERENTIAL CARRIER STAND

(75) Inventors: Gregory James Maser, Woodburn; Sean Karl Hoefer, Wabash, both of IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/471,150

(22) Filed: Dec. 23, 1999

(51) Int. Cl.[7] ..... B66F 5/04
(52) U.S. Cl. ..... 269/17; 269/69; 269/296
(58) Field of Search ..... 269/17, 69, 126–129, 269/296, 47, 50, 51; 254/2 B, 133, 134, DIG. 16

(56) References Cited

U.S. PATENT DOCUMENTS

| | | | | |
|---|---|---|---|---|
| 1,350,119 | | 8/1920 | Staley . | |
| 1,361,262 | | 12/1920 | Jacob . | |
| 1,389,233 | | 8/1921 | West . | |
| 1,503,188 | * | 7/1924 | Hoyoux | 269/296 |
| 1,515,915 | | 11/1924 | Valenta . | |
| 1,556,882 | | 10/1925 | Weaver . | |
| 2,654,147 | | 10/1953 | Wilson et al. . | |
| 2,702,689 | | 2/1955 | Smith . | |
| 2,748,459 | * | 6/1956 | Orr | 269/296 |
| 2,903,258 | * | 9/1959 | Jovanovich | 269/296 |
| 3,049,243 | * | 8/1962 | Buice | 254/2 B |
| 3,154,315 | | 10/1964 | Ash . | |
| 3,198,579 | | 8/1965 | Adams . | |
| 3,269,494 | | 8/1966 | Tantlinger et al. . | |
| 3,279,569 | | 10/1966 | Kieser et al. . | |
| 3,559,981 | | 2/1971 | Abshear . | |
| 3,650,360 | | 3/1972 | King et al. . | |
| 4,206,911 | | 6/1980 | Harrison . | |
| 4,463,937 | | 8/1984 | Celette . | |
| 4,560,151 | * | 12/1985 | Grundy | 269/296 |
| 4,564,178 | * | 1/1986 | Steffe | 269/17 |
| 4,792,130 | * | 12/1988 | Ardent | 269/296 |
| 4,981,200 | | 1/1991 | Gee . | |
| 5,044,475 | | 9/1991 | Clark . | |
| 5,046,589 | | 9/1991 | Bright . | |
| 5,139,233 | * | 8/1992 | Goss | 254/17 |
| 5,505,425 | | 4/1996 | Shelton . | |
| 5,649,612 | | 7/1997 | Walker et al. . | |
| 5,667,207 | | 9/1997 | Pistole . | |
| 5,887,687 | | 3/1999 | Williams . | |

* cited by examiner

*Primary Examiner*—Robert C. Watson
(74) *Attorney, Agent, or Firm*—Liniak, Berenato, Longacre & White

(57) ABSTRACT

A universal axle and differential carrier stand comprising a base provided with a pair of upright support arms secured to the base at their lower end, and being horizontally adjustable for providing a variable spacing between the pair of support arms. A pair of axle clamps for receiving and positively engaging the vehicle axle or a pair of differential carrier mounts for mounting the differential carrier are alternatively and interchangeably affixed to upper ends of the support arm. Furthermore, the axle clamps and the differential carrier mounts may be adjustable in height. The stand may be quickly and easily loaded and unloaded, because no tools are required to operate axle clamps. The base is provided with caster wheels that allow easy movement of the universal stand with or without vehicle components.

15 Claims, 5 Drawing Sheets

UNIVERSAL AXLE AND DIFFERENTIAL CARRIER STAND

BACKGROUND OF THE INVENTION

1. Field of the Invention

The present invention relates to vehicle axle stands, and more particularly to a universal axle and differential carrier stand.

2. Description of the Prior Art

Stands are important and frequently used equipment in automobile garages and vehicle drivetrain manufacturing plants. Particularly, they are used for holding and supporting vehicle axles and/or differential assemblies during repair or teardown and analysis. Currently, there exist a large number of stands for supporting straight beam type axles of various sizes and independent differential carriers of various dimensions. Big manufacturers or garages waste a great deal of floor space to house all the different axle stands and differential carrier stands, and valuable time is spent switching from stand to stand.

Furthermore, the prior teaches separate stands for either vehicle axles or differential carriers. None of them discloses a universal stand that may support both axles and differential carriers. Also, existing means for clamping axles or mounting differential carriers are relatively complex and cumbersome, and not all the axle stands include axle clamping means.

SUMMARY OF THE INVENTION

The present invention alleviates the drawbacks of the prior art. The present invention provides a universal axle and differential carrier stand for motor vehicles capable to support both vehicle axles of a straight beam type and differential carriers and to fit a wide variety of axle models and their geometries.

The universal axle and differential carrier stand in accordance with present invention comprises a base provided with a pair of upright support arms secured to the base at their lower end, and being horizontally adjustable for providing a variable spacing between the pair of support arms. A pair of axle clamps for receiving and positively engaging the vehicle axle or a pair of differential carrier mounts for mounting the differential carrier are alternatively and interchangeably affixed to upper ends of the support arms. Furthermore the axle clamps and the differential carrier mounts may be adjustable in height. The stand may be quickly and easily loaded and unloaded, because no tools are required to operate axle clamps. It is contemplated that the base is provided with casters that allow easy movement of the universal stand with or without vehicle components.

BRIEF DESCRIPTION OF THE DRAWINGS

Other objects and advantages of the invention will become apparent from a study of the following specification when viewed in light of the accompanying drawings, wherein.

DETAILED DESCRIPTION

Figure 1:
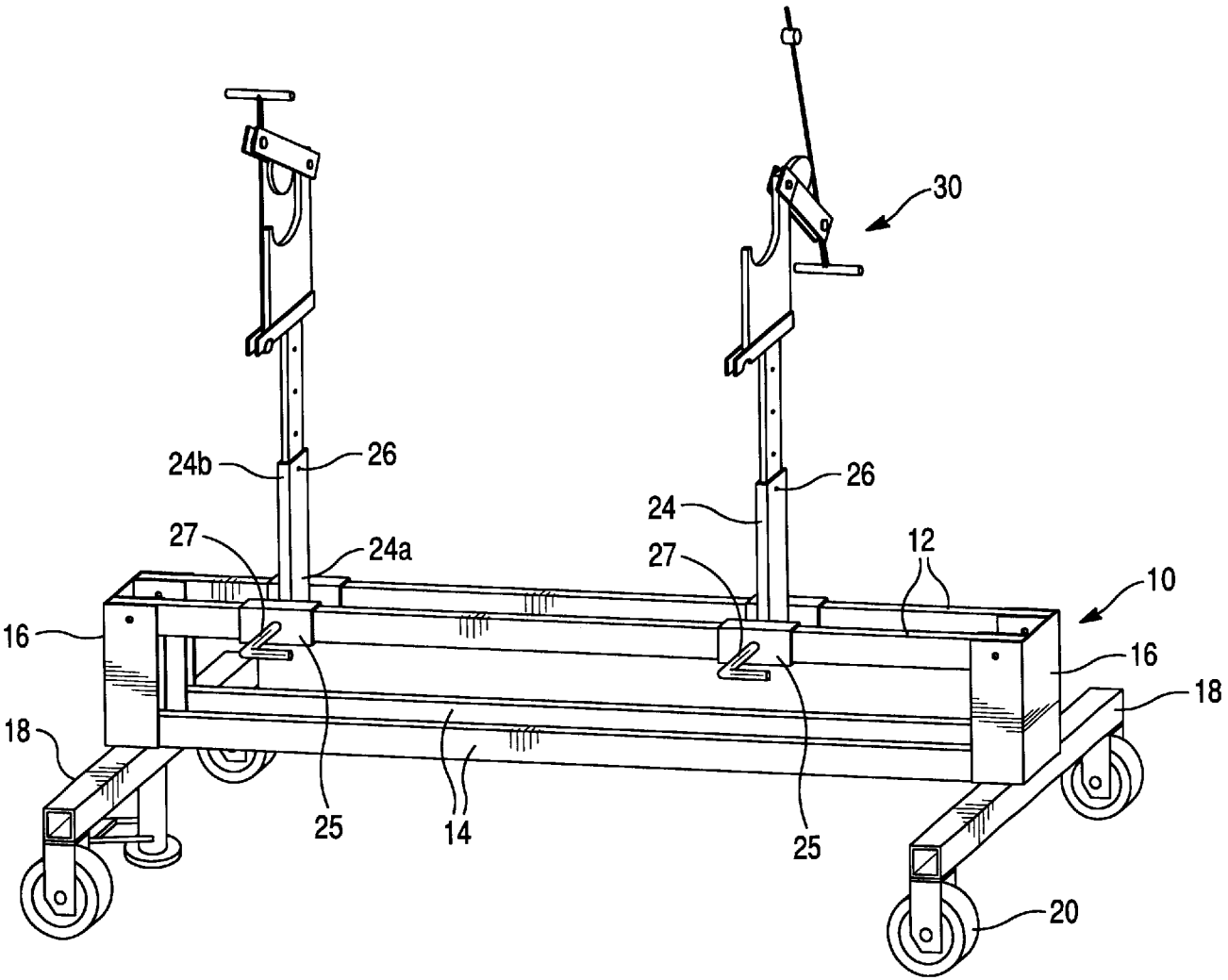
FIG. 1 is a perspective view of a universal axle and differential carrier stand in accordance with the present invention.

FIG. 1 of the drawings illustrates a novel arrangement a universal axle and differential carrier stand in accordance with the present invention. The stand comprises a base 10 supporting a pair of upright support arms 24, and a pair of interchangeable axle tube clamping assemblies 30 each associated with the corresponding support arms 24.

The base 10, in accordance with the preferred embodiment of the present invention, includes a pair of upper generally horizontal support rail 12, defining a top surface, and a pair of lower generally horizontal support rail 14, defining a bottom surface, interconnected at their ends by a pair of vertical end plates 16. The base 10 further includes wheel support rails 18 secured to the end plates 16 preferably by welding. Attached at each end of the wheel support rails 18 are a plurality of wheels 20 providing mobility to the stand. Also, the base 10 may be provided with any appropriate brake device (not shown) well known in the prior art, for securing the universal stand in a locked and stable position. For example, wheels 20 may be provided with brake means, such as represented by the reference numeral 22 in FIG. 3.

In the preferred embodiment, the support rails 12, 14 and 18 are all made of steel tubes, preferably of a square cross section. However, other appropriate materials may be utilized in the present invention.

The support arms 24 are generally identical and made of hollow rectangular sleeves having a first end 24*a* and a second end 24*b*. As shown in FIG. 1, the first ends 24*a* of the support arm 24 are fixed (preferably by welding) to sliding supports 25. Each of the sliding supports 25 is slidingly secured to the upper support rails 12, thus, making the support arms 24 horizontally adjustable for providing a variable spacing between them in order to accommodate wide range of axle geometries. Each of the sliding supports 25 may be provided with a locking mechanism 27, such as bolt, wedge, clamp, cam, etc., for securing the support arm 24 in a selected horizontal position. The second end 24*b* of the support arm 24 is provided with a hole 26 extending completely therethrough.

Figure 3:
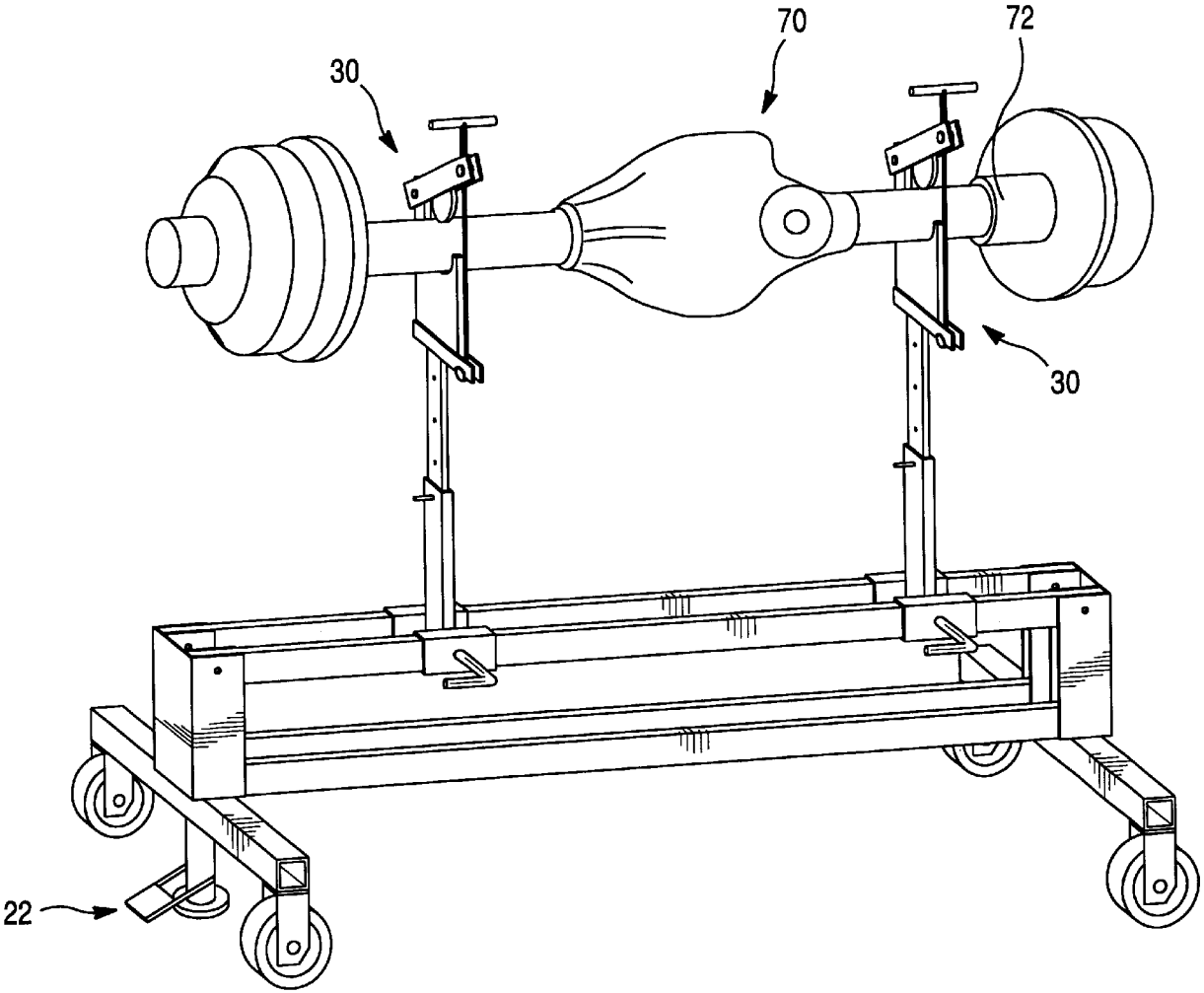
FIG. 3 is a perspective view of the universal axle and differential carrier stand supporting a straight beam type axle.
Figure 5:
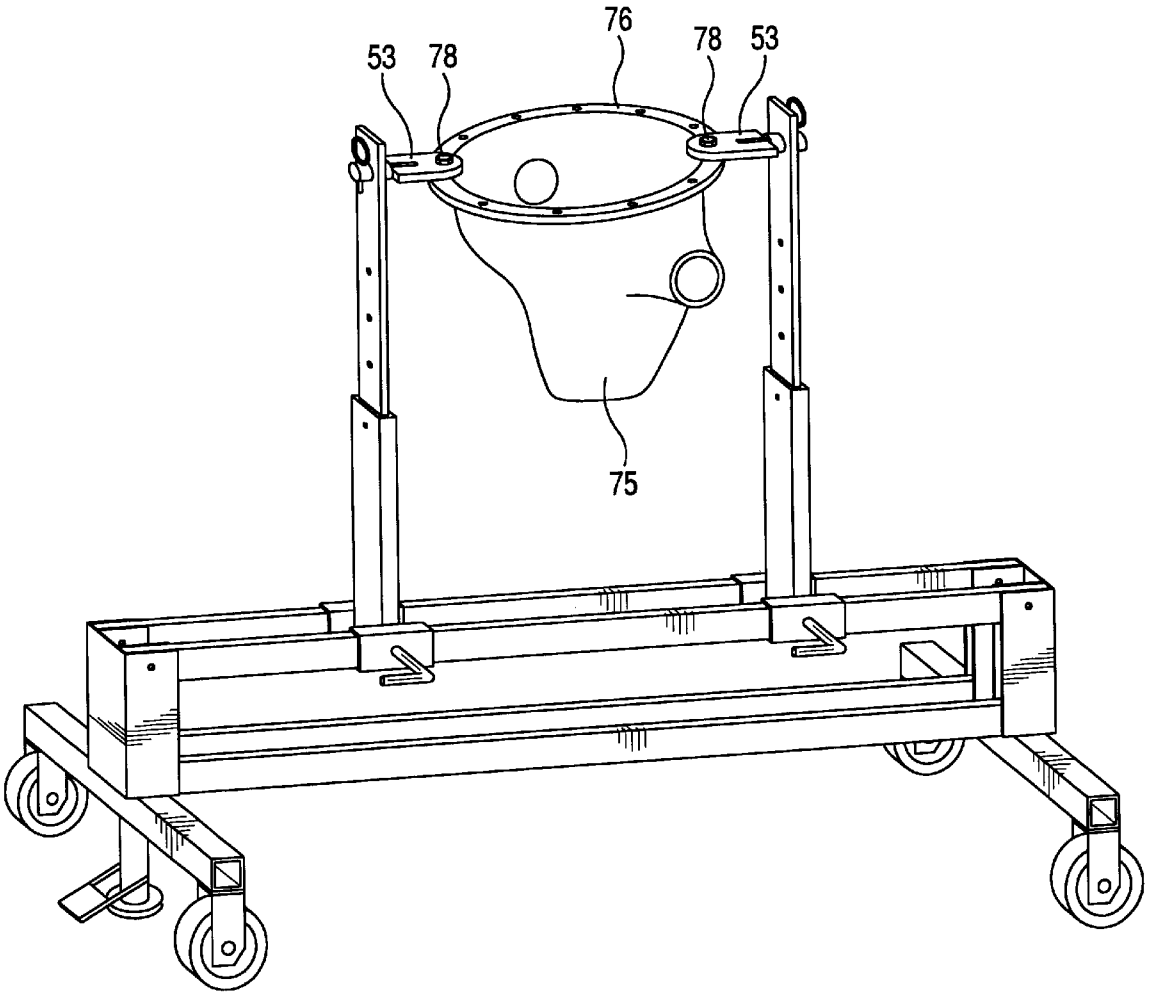
FIG. 5 is a perspective view of the universal axle and differential carrier stand supporting an independent axle differential carrier.

The universal stand may be provided with a pair of axle clamp assemblies 30 for securely supporting a straight beam type axle 70 shown in FIG. 3, as well as a pair of independent axle differential carrier mounting assemblies 50 for mounting an independent axle differential carrier 75 shown in FIG. 5. Each pair of axle clamp assemblies 30 and differential carrier mounting assemblies 50 is alternatively and interchangeably affixed to the second ends 24*b* of the support arms 24.

Figure 2A:
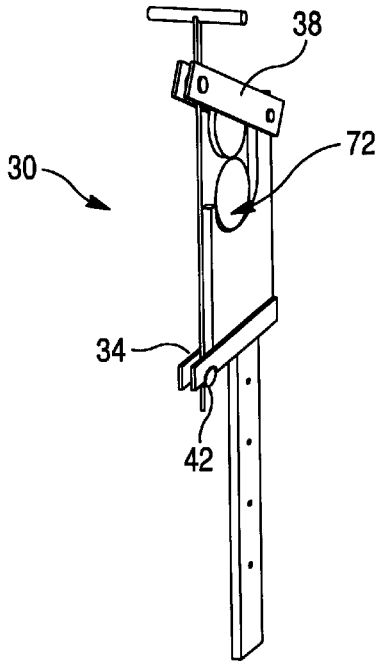
FIG. 2A is a perspective view of an axle tube clamp assembly in accordance with the present invention in an open position.
Figure 2B:
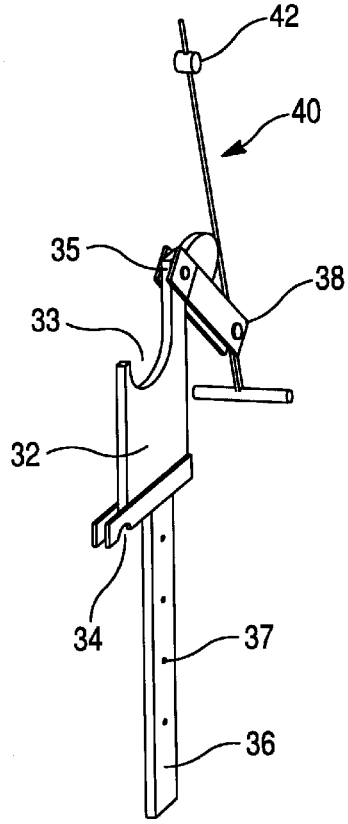
FIG. 2B is a perspective view of the axle tube clamp assembly in accordance with the present invention in a clamped position.

The axle clamp assembly 30 is illustrated in detail in FIGS. 2A and 2B, wherein FIG. 2A shows the clamp assembly 30 in the open position, ready to receive an axle tube, and FIG. 2B shows the clamp assembly 30 in its closed position clamping the axle tube schematically represented by a reference numeral 72. The clamp assembly 30 includes a U-shaped axle tube rest 32 provided with a semi-cylindrical notch 33 for receiving the axle tube 72, and a small groove 34 function of which will be explained herebelow. Secured to a bottom of the tube rest 32 is a support bar 36 provided with a plurality of vertically evenly spaced holes 37 to provide a vertical adjustment. A clamping bar 38 is pivotally attached to the tube rest 32 at a pivot 35. Furthermore, the axle clamp assembly 30 includes a clamping T-bar 40 provided with a threaded pin 42 adapted to engage the groove 34 in the tube rest 32. In order to clamp the axle tube 70, first the clamp bar 38 is put in its open position, shown in FIG. 2A, then the axle tube 72 is positioned in the notch 33. After that, the clamp bar 38 is rotated toward the axle tube 72, the threaded pin 42 engages the groove 34 in the tube rest 32, and the T-bar is manually rotated until an appropriate clamping force is achieved.

In order to adjustably secure the clamp assembly 30 to the support arm 24, the support bar 36 is inserted into the second ends 24*b* of the support arm 24. Once the desired height of the clamp assembly 30 is obtained and the holes 26 and 37 are aligned, then a quick release pin (not shown) is inserted into the holes to secure the support bar 36 to the hollow arm 24 in a fixed position.

The universal stand supporting the straight beam type axle 70 is illustrated in FIG. 3.

Figure 4B:
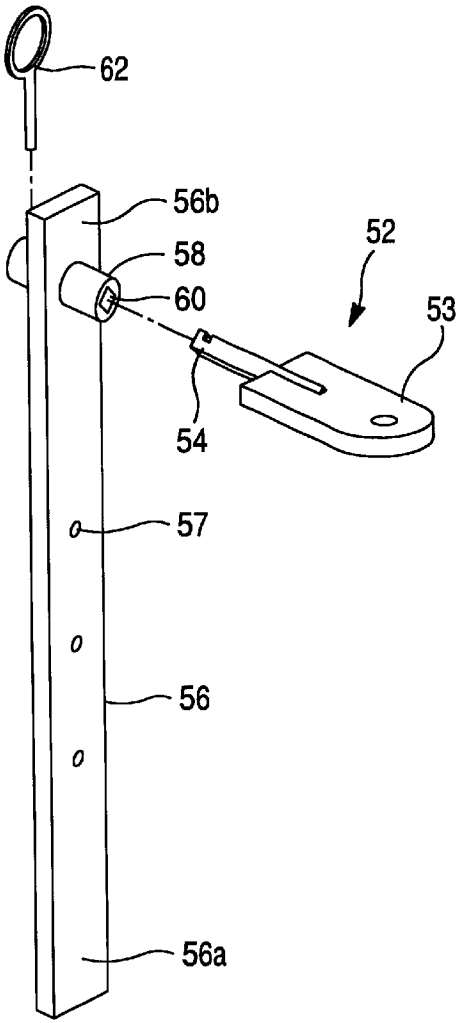
FIG. 4B is a perspective exploded view of an independent axle differential carrier mounting assembly in accordance with the present invention in an open position.
Figure 4A:
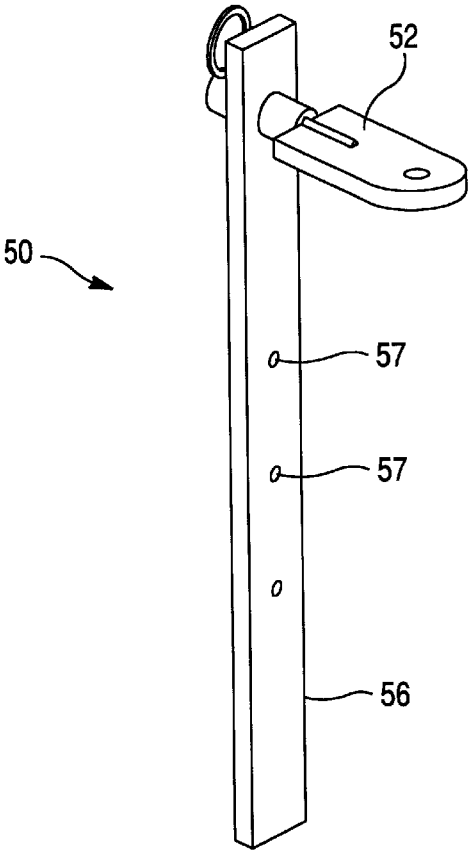
FIG. 4A is a perspective view of an independent axle differential carrier mounting assembly in accordance with the present invention in an open position.

As was mentioned above, the universal stand alternatively may be provided with the differential carrier mounting assemblies 50 interchangeably affixed to the second ends 24*b* of the support arms 24. FIGS. 4A and 4B show perspective view and perspective exploded view respectively of the differential carrier mounting assembly 50 that comprises a carrier mounting adapter 52 including a carrier mounting plate 53 provided with a mounting pin 54 fixed thereto, a support bar 56 having a lower end 56*a* and an upper end 56*b*, and a rest sleeve 58 secured at the upper end 56*b* of the bar 56 perpendicular thereto. The mounting pin 54 of the adapter 52 has a polygonal (preferably square) cross-section. The mounting pin 54 is inserted in a corresponding opening 60 in the rest sleeve 58. This feature allows positioning the mounting plate 53 both vertically and horizontally, thus selectively positioning the differential carrier 75. A lock pin 62 is employed to secure the mounting adapter 52 in the sleeve 58. The support bar 56 is provided with a plurality of vertically evenly spaced holes 57 to provide vertical adjustment.

In order to adjustably secure the differential carrier mounting assembly 50 to the support arm 24, the support bar 56 is inserted into the second ends 24*b* of the support arm 24. Once the desired height of the carrier mounting assembly 50 is obtained and the holes 26 and 57 are aligned, then the quick release pin (not shown) is inserted into the holes to secure the support bar 56 to the hollow arm 24 in a fixed position.

The universal stand supporting the independent axle differential carrier 75 is illustrated in FIG. 5. As illustrated, a cover plate (not shown) is removed from the carrier 75 and the mounting plates 53 are fastened to a cover plate flange 76 by means of bolts 78.

Therefore, the novel arrangement of the universal axle and differential carrier stand of the present invention as constructed in the above-described embodiment, is capable to support both vehicle axles of the straight beam type and the independent axle differential carriers by employing interchangeable the axle clamp assemblies and the independent axle differential carrier mounting assemblies. The universal stand is adapted to fit a wide variety of axle models and their geometry.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A universal axle and differential carrier stand comprising:

a base, said base having a top surface and a bottom surface;

at least one upright support arm having a first end and a second end;

said first end of said support arm being secured to said base;

at least one of an axle clamping means for receiving and positively engaging a vehicle axle and a differential carrier mounting means for positively engaging a differential carrier affixed to said second end of said support arm, wherein said axle clamping means and said carrier mounting means is alternatively and interchangeably affixed to said second end of said support arm.

2. A universal axle and differential carrier stand comprising:

a base, said base having a top surface and a bottom surface;

a pair of upright support arms each having a first end and a second end, said first ends of said support arms being secured to said base; and a pair of axle clamping means for receiving and positively engaging a vehicle axle and a pair of differential carrier mounting means for positively engaging a differential carrier affixed to said second end of each of said support arms;

wherein each of said axle clamping means and said carrier mounting means is alternatively and interchangeably affixed to said second end of each of said support arms.

3. A universal axle and differential carrier stand comprising:

a base, said base having a top surface and a bottom surface;

at least one upright support arm having a first end and a second end;

said first end of said support arm being secured to said base;

at least one of an axle clamping means for receiving and positively engaging a vehicle axle and a differential carrier mounting means for positively engaging a differential carrier affixed to said second end of said support arm, wherein said axle clamping means comprising:

an axle tube rest for receiving a vehicle axle tube;

a support bar attached to a bottom surface of said tube rest at one end and removably secured to said second end of said support arm at the other end;

a clamping bar pivotable on said tube rest and adapted to positively engage the axle tube, and a locking device for locking said clamping bar relative to said axle tube rest.

4. A universal axle and differential carrier stand comprising:

a base, said base having a top surface and a bottom surface;

at least one upright support arm having a first end and a second end;

said first end of said support arm being secured to said base;

at least one of an axle clamping means for receiving and positively engaging a vehicle axle and a differential carrier mounting means for positively engaging a differential carrier affixed to said second end of said support arm, wherein said differential carrier mounting means comprising:

a support bar having a lower end and an upper end;

said lower end removably secured to said second end of said support aim;

a rest sleeve provided at said upper end of said support bar perpendicular thereto and extending in a substantially horizontal direction, and a differential carrier mounting adapter including a carrier mounting plate for mounting the differential carrier and a mounting pin fixed thereto, said pin of said mounting adapter removably secured in said sleeve so that the differential carrier may be mounted at a number of different angular positions about said horizontal direction.

5. The universal axle and differential carrier stand as defined in claim 4, wherein said differential carrier mounting plate engaging a bolt hole in said carrier.

6. The universal axle and differential carrier stand as defined in claim 4, wherein said sleeve having a polygonal opening therethrough and said pin having a uniform polygonal cross-section corresponding to said polygonal opening in said rest sleeve.

7. The universal axle and differential carrier stand as defined in claim 4, further including a locking means for restraining axial movement of said mounting adapter.

8. A universal axle and differential carrier stand comprising:

a base, said base having a top surface and a bottom surface;

at least one upright support arm having a first end and a second end;

said first end of said support and being secured to said base;

at least one of an axle clamping means for receiving and positively engaging a vehicle axle and a differential carrier mounting means for positively engaging a differential carrier affixed to said second end of said support arm, wherein said axle clamping and differential carrier mounting means comprising:

an axle tube rest for receiving a vehicle axle tube;

a support bar having a lower end and an upper end, said upper end being attached to a bottom surface of said tube rest at one end, said lower end being removably secured to said second end of said support arm;

a clamping bar pivotable on said tube rest and adapted to positively engage the axle tube;

a locking device for locking said clamping bar relative to said axle tube rest;

a rest sleeve provided at said upper end of said support bar perpendicular thereto and extending in a substantially horizontal direction, and a differential carrier mounting adapter including a carrier mounting plate for mounting the differential carrier and a mounting pin fixed thereto, said pin of said mounting adapter being removably secured in said sleeve so that the differential carrier may be mounted at a number of different angular positions.

9. The universal axle and differential carrier stand as defined in claim 8, wherein said differential carrier mounting plate engaging a bolt hole in said carrier.

10. The universal axle and differential carrier stand as defined in claim 8, wherein said sleeve having a polygonal opening therethrough and said pin having a uniform polygonal cross-section corresponding to said polygonal opening in said rest sleeve.

11. The universal axle and differential carrier stand as defined in claim 8, further including a locking means for restraining axial movement of said mounting adapter.

12. The universal axle and differential carrier stand as defined in claim 1, wherein said stand is provided with a brake means for restraining the movement thereof.

13. A universal axle and differential carrier stand comprising:

a base, said base having a top surface and a bottom surface, said base being provided with a plurality of wheels secured to said bottom surface of said base for rendering said base mobile;

a pair of upright support arms each having first end and a second end, said first ends of said support arms being secured to said base; said support arms being horizontally adjustable relative to said base for providing a variable spacing between said pair of support arms;

an axle clamping means for receiving and positively engaging a vehicle axle, said axle clamping means comprising:

an axle tube rest for receiving a vehicle axle tube;

a support bar having a lower end and an upper end, said upper end being attached to a bottom surface of said tube rest at one end, said lower end being removably secured to said second end of said support arm, said lower end of said support bar can be adjusted in height relative to said support arm;

a clamping bar pivotable on said tube rest and adapted to positively engage the axle tube, and a locking device for locking said clamping bar relative to said axle tube rest;

a differential carrier mounting means for positively engaging a differential carrier, said carrier mounting means comprising:

a support bar having a lower end and an upper end; said lower end removably secured to said second end of said support arm, said lower end of said support bar can be adjusted in height relative to said support arm;

a rest sleeve provided at said upper end of said support bar perpendicular thereto and extending in a substantially horizontal direction;

a differential carrier mounting adapter including a carrier mounting plate for mounting the differential carrier and a mounting pin fixed thereto, said pin of said mounting adapter removably secured in said sleeve so that the differential carrier may be mounted at a number of different angular positions about said horizontal direction, said differential carrier mounting plate engaging a bolt hole in said carrier, and a locking means for restraining axial movement of said mounting adapter, wherein each of said axle clamping means and said carrier mounting means is alternatively and interchangeably affixed to said second end of each of said support arms.

14. The universal axle and differential carrier stand as defined in claim 13, further including a brake means for restraining the movement of said stand.

15. The universal axle and differential carrier stand as defined in claim 13, wherein said sleeve having a polygonal opening therethrough and said pin having a uniform polygonal cross-section corresponding to said polygonal opening in said rest sleeve.

* * * * *